United States Patent [19]

Schmeider

[11] 4,403,766

[45] Sep. 13, 1983

[54] BLOCK AND PULLEY ARRANGEMENT

[75] Inventor: Adolf Schmeider, Versbach, Fed. Rep. of Germany

[73] Assignee: Gg. Noell GmbH, Wurzburg, Fed. Rep. of Germany

[21] Appl. No.: 123,420

[22] Filed: Feb. 21, 1980

[51] Int. Cl.[3] ..... B66D 3/08

[52] U.S. Cl. ..... 254/399; 254/416

[58] Field of Search ..... 254/399, 398, 393, 394, 254/337, 409, 412, 416, 415

[56] References Cited

U.S. PATENT DOCUMENTS

| | | | |
|---|---|---|---|
| 2,973,942 | 3/1961 | Schaper | 254/399 |
| 3,863,898 | 2/1975 | Brackin | 254/399 |
| 4,069,921 | 1/1978 | Raugulis et al. | 254/337 |
| 4,098,492 | 7/1978 | Wilkinson | 254/399 |

FOREIGN PATENT DOCUMENTS

| | | | |
|---|---|---|---|
| 1219229 | 1/1971 | United Kingdom | 254/399 |

*Primary Examiner*—Billy S. Taylor

*Attorney, Agent, or Firm*—Horst M. Kasper

[57] ABSTRACT

A hoist for lifting appliances, and more specifically a block-and-pulley arrangement, or a block-and-tackle arrangement. A plurality of pulleys is arranged between two pulley-housing parts. Each of said plurality of pulleys is supported by its own relatively short shaft. Half of the pulley-supporting shafts is supported in the upper pulley-housing part, and the other half of the pulleys is supported by partitions in the lower pulley-housing part. Pairs of partitions in the upper pulley-housing part and pairs of partitions in the lower pulley-housing part are interleaving or out of registry. The load-supporting hook has a shaft which projects vertically through both pulley-housing parts by a bearing, so that it is rotatable relative to the upper pulley-housing part. A load supporting cross-member is arranged in transverse relation to the hook-bearing shaft and the latter projects through its center. The cross-member is supported by the lower pulley-housing by the intermediary of a bearing, so that the cross-member is rotatable relative to the lower pulley-housing. This arrangement of parts ensures safe operation of the hoist, or the pulley-and-tackle arrangement, even if any of the constituent parts of the latter should break or fail.

1 Claim, 3 Drawing Figures

BLOCK AND PULLEY ARRANGEMENT

BACKGROUND OF THE INVENTION

This invention relates to an improvement of the hoist for lifting appliances or block-and-tackle arrangements described in the German Offenlegungsschrift 27 03 384, which is the closest prior art known to applicant. This prior art device has the disadvantage that its pulley-housing comprises a single structure which, in case that it breaks, allows the load to drop to the ground.

In the above referred-to prior art device the pulleys are arranged to opposite sides of a common shaft and if that shaft breaks, the dual cable or rope arrangement becomes illusionary.

It is, therefore, one object of the present invention to provide a mechanism as generally described in the above referred-to German Offenlegungsschrift, but in which the pulley-housing, and the way the load bearing parts are affixed to it, provide perfect security against any possible failures.

SUMMARY OF THE INVENTION

The pulley housing is subdivided and includes an upper part and a lower part. Each part has a plurality of pairs of internal partitions. The pairs of partitions of the upper pulley-housing and the pairs of partitions of the lower pulley-housing interleave. The above pairs of partitions support the pulleys for the cable or rope of the device. Each pulley has its individual short shaft for supporting it on the above pairs of partitions. These shafts interleave when the upper and the lower pulley-housing are in position and are then arranged in coaxial relation so that the operation of each pulley is independent of the operation of the other pulleys. The load bearing hook has a shaft which projects through both pulley-housing parts and is rotatbly supported by the upper pulley-housing part. A load bearing cross-member is arranged transversely to the shaft of the hook and supported by the lower pulley-housing part by the intermediary of a bearing which allows rotation of the cross-member relative to the lower pulley-housing part.

DESCRIPTION OF PREFERRED EMBODIMENT

Figure 2:
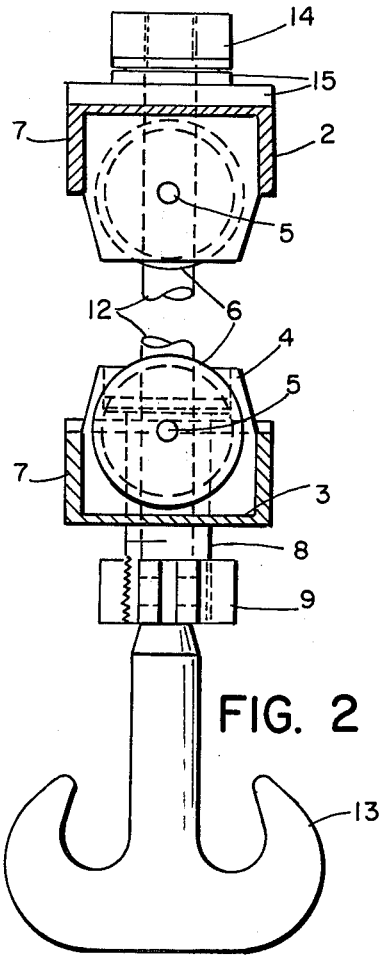
FIG. 2 is substantially a vertical section along II—II of FIG. 1.
Figure 3:
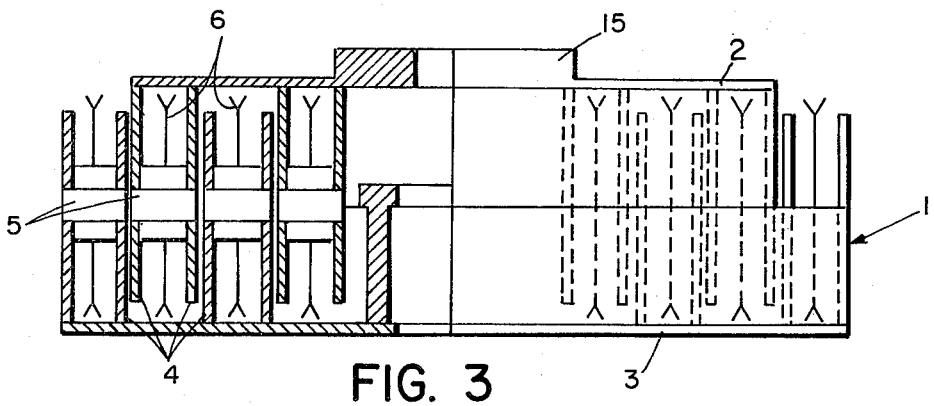
FIG. 3 is substantially a vertical section through the pulley-housing showing the latter diagrammatically in closed position, i.e. with its two constituent parts in engagement, some of the parts of the structure shown in FIG. 1 having been deleted in FIG. 3.

Referring now to the drawings, the pulley-housing 1 includes an upper part 2 and a lower part 3. Both parts are channel-shaped or U-shaped, and arranged in such a way that their web portions are in parallel planes and their flange portions project in opposite directions from their web portions. The shaft supporting plates 4 are affixed to parts 2 and 3 as, for instance, by welding. Pairs of plates 4 in part 2 are equidistant, and pairs of plates 4 in part 3 are equidistant. Pairs of plates in parts 2 and 3 have the same spacing; but the pairs of plates or partitions 4 in part 2 and the pairs of plates or partitions 4 in part 3 are arranged out of registry. Each pair of supporting plates or partitions 4 supports a short shaft 5 which, in turn, supports a pulley 6. When pulley-housing parts 2,3 are in engagement, as shown in FIG. 3, each pulley 6 in upper housing part 2 is arranged between a pulley in lower housing part 3. In other words, pulleys 6 in housing parts 2,3 are interleaving. The sides 7 of housing 2,3 project a smaller distance from the bases of housing parts 2,3 than the supporting plates or partitions 4, as clearly shown in FIG. 2. When pulley-housing parts 2,3 are in engagement, i.e. the side or end plates 7 engage each other, the short shafts 5 of pulleys 6 in the upper housing part 2 and in the lower housing part 3 are arranged in coaxial relation.

The hollow shaft 8 of the transversely arranged load supporting member 9 projects through the web portion of the lower pulley-housing part 3 and is supported on said part 3 by a screw nut 10. A bearing 11, such as a ball bearing, is interposed between nut 10 and housing part 3, allowing a relative rotary motion between load-bearing member 9 and housing part 3.

The shaft 12 of the load-bearing hook 13 projects through the center of transversely arranged load-bearing member 9 and through hollow shaft 8 and further projects through the web portion of the upper pulley-housing 2. Reference numeral 14 has been applied to indicate a nut holding in position the upper end of shaft 12. A bearing 15 such as, for instance, a ball bearing, is interposed between nut 14 and the upper housing part 3, thus allowing rotary motions between hook 13 and its shaft 12 and the upper housing portion 2.

Figure 1:
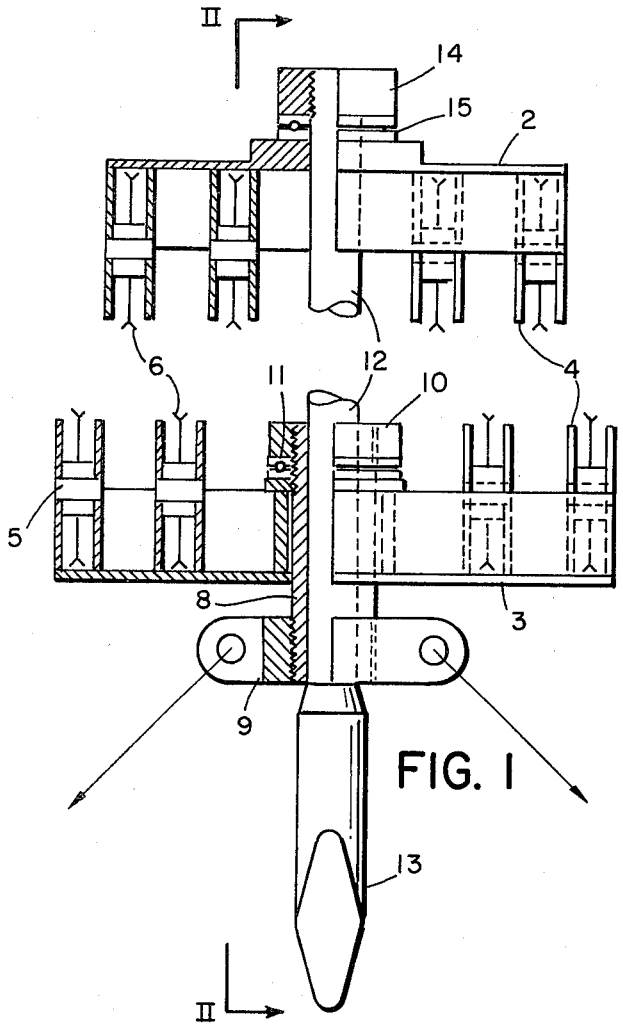
FIG. 1 is substantially a vertical section across the pulley-housing when its constituent parts are separated and shows some parts in section rather than in elevation.

As generally known in the art the load is carried in part by hook 13 and in part by transverse member 9, as indicated in FIG. 1 by a pair of arrows pointing away from part 9. Thus the portion of the load supported by hook 13 is transmitted to the upper housing part 2, and the portion of the load supported by transverse member 9 is transmitted via the housing part 3 to its support plates or partitions 4.

In case that one of short shafts 5 should break, because of the separate support of each pulley 6 and because of their alternate support in housing parts 2 and 3, the supporting function of the cable or rope is in no way adversely affected.

If the hook 13 should break or the transverse member 9 should break, the entire load is transmitted from the part which remained intact to the individual short shafts 5.

If one of the parts 2 or 3 should break, the entire load is transmitted from the defective part to the part which remains intact.

Thus the present invention provides a hoist or a block-and-tackle therefor which is perfectly safe, even if any essential parts thereof should break, or fail.

In the drawings the loops of the rope or cable which interconnect parts 2 and 3 have not been shown, because they are obvious, and do not form part of this invention.

I claim as my invention:

1. In a hoist for a load-lifting applicance including a housing for the pulleys, a shaft for supporting the load hook and projecting through said housing and being affixed to said housing, said pulleys being arranged inside said housing in coaxial relation to opposite sides of said shaft, and said hoist further including an additional load bearing member besides said load hook, the combination of (a) a pulley-housing (1) including an upper pulley-housing part (2) and a lower pulley-housing part (3);

(b) a plurality of pairs of shaft-support plates (4) affixed to said upper pulley-housing part (2) and a plurality of pairs of shaft-support plates (4) affixed to said lower pulley-housing part (3), said pairs of shaft support plates in said upper and said lower pulley-housing parts (2,3) interleaving when said upper pulley-housing part (2) and said lower pulley-housing part (3) are in engagement;

(c) a plurality of pulleys (6) and a plurality of pulley-supporting shafts (5), each of said plurality of pulleys (6) being supported by a separate shaft of said plurality of pulley-supporting shafts (5);

(d) some of said plurality of pulley-supporting shafts (5) being supported by pairs of said shaft-supporting plates (4) affixed to said upper pulley-housing part (2), and others of said plurality of pulley-supporting shafts (5) being supported by pairs of said shaft-supporting plates (4) affixed to said lower pulley-housing part (3);

(e) a shaft (12) for supporting said load hook (13) rotatably supported by said upper housing part (2); and (f) an additional load supporting member (9) rotatably supported by said lower housing part (3).

* * * * *